United States Patent [19]

Ballester

[11] 4,408,698

[45] Oct. 11, 1983

[54] NOVEL COVER AND CONTAINER ASSEMBLY

[76] Inventor: Jose F. Ballester, GPO Box 4523, San Juan, P.R. 00936

[21] Appl. No.: 387,034

[22] Filed: Jun. 10, 1982

Related U.S. Application Data

[63] Continuation-in-part of Ser. No. 209,823, Nov. 24, 1980, Pat. No. 4,334,631, and Ser. No. 272,307, Jun. 10, 1981.

[51] Int. Cl.[3] ..... B65D 41/16; B65D 41/18

[52] U.S. Cl. ..... 220/306; 220/72; 150/55

[58] Field of Search ..... 220/306, 307, 72, 74; 150/0.5

[56] References Cited

U.S. PATENT DOCUMENTS

| | | | |
|---|---|---|---|
| 4,010,867 | 3/1977 | Jones | 220/72 |
| 4,210,258 | 7/1980 | Von Holdt | 220/306 |
| 4,256,240 | 3/1981 | Woinarski | 220/306 |
| 4,308,970 | 1/1982 | Von Holdt | 220/306 |
| 4,334,631 | 6/1982 | Ballester | 220/306 |
| 4,349,119 | 9/1982 | Lietica | 220/72 |

*Primary Examiner*—George T. Hall

*Attorney, Agent, or Firm*—John M. Bain; Paul H. Kochanski

[57] ABSTRACT

There is disclosed a novel cover and container assembly having a container portion and a cover portion wherein there is formed a bellows-like portion of at least two annular grooves separated by a ridge on the cover or container portion for dampening external pressure forces after impact and further having an interlocking assembly providing a contact area between the cover and the container. The interlocking assembly provides a snap-type closing which ensures a tighter fit with less chance of opening with one annular groove including rib members located near the edge of the cover, with the rib members providing means for separating the cover from the container.

13 Claims, 3 Drawing Figures

NOVEL COVER AND CONTAINER ASSEMBLY

This application is a continuation-in-part of the following previously filed applications: U.S. Ser. No. 209,823 filed Nov. 24, 1980 now U.S. Pat. No. 4,334,631 and U.S. Ser. No. 272,307 filed June 10, 1981.

FIELD OF THE INVENTION

This invention relates to a cover and container assembly, in particular to a cover and container assembly provided with an hermetic seal and a bellows portion for dampening internal pressure forces upon impact.

BACKGROUND OF THE INVENTION

With the advent of plastics technology there has been movement in the container industry from metal storage cans and containers to like products made out of plastic. Such changes in materials of construction has lead to problems since plastic containers are more pliable and lack the rigid construction of metal containers and thereby are more susceptible to accidental opening when dropped or leaking when they are roughly handled during transfer operations. Such accidental opening or leaking arises out of an increase of internal pressure or force upon the lid and seal of the container when the plastic container is deformed.

Many solutions have been advanced to alleviate these problems by the development of interlocking sealing assemblies. One such assembly is a single interlocking seal without any other system to attempt to prevent such occurrences as disclosed in U.S. Pat. No. 3,840,144 to Dry.

In U.S. Pat. No. 4,210,258 to Von Holdt, there is shown a centrally located single shallow annular groove or "corrugation ring" on the cover of a plastic container that assists in receiving and dampening internal forces when a bucket is dropped. The internal forces dampened by using the shallow annular groove are internal forces directed toward the cover of the container. The shallow annular groove is not fully able to dampen the internal forces that act upon a peripherally located double interlocking sealing assembly, and accordingly, the absorption of stresses is at the periphery of the lid and the side wall, consequently the sealing assembly deforms such that it is caused to "pop open" and thereby spill the contents of the container.

In U.S. Pat. No. 3,817,420 to Heisler there is shown an annular V-portion of the cover adjacent to a sealing assembly to provide a spring or shock member for pressure against the cover. Such V-portion has also been shown to be inadequate when the container is dropped since it does not fully dampen the internal forces that act upon the sealing assembly since as the V-portion deforms to dampen the internal force it also deforms the sealing assembly causing the seal to disengage.

Additionally, all the prior art sealing assemblies require that an individual when attempting to open the container must apply a force with a flat edge object a plurality of times around the peripheral edge of the cover of the container. This procedure can once again lead to the problem of accidental spills since it is necessary to rotate the container to reach the point where force will be applied. Additionally, the type of opening procedure leads to distortion of the sealing assembly which prevents tight sealing upon reclosing the container.

Furthermore, none of the disclosed embodiments in the art provide an adequate barrier such that the internal forces generated when a container is dropped are dampened in such a manner as to not affect the sealing assembly.

OBJECTS OF THE INVENTION

It is an object of the present invention to provide a novel cover and container assembly.

Another object of the present invention is to provide a novel cover and container assembly having a single interlocking hermetic seal.

Still another object of the present invention is to provide a novel cover and container assembly that relieves internal pressure inside the container when it is dropped and deformed upon impact.

A further object of the present invention is to provide a novel cover and container assembly with a hermetic seal having a sealing surface accommodating dimensional variations during the manufacture as well as to accommodate a greater degree of distortion of the assembly.

Yet another object of the present invention is to provide a novel cover and container assembly which isolates the force that tries to separate the lid from the remainder of the container assembly.

Still another object of the present invention is to provide a novel cover and container assembly that acts as a shock absorber.

Yet another object of the present invention is to provide a novel cover and container assembly which rebounds back to its original shape after deformation.

Still another object of the present invention is to provide a novel cover and container assembly resisting separation of the lid and the plastic container body on certain kinds of impact.

A further object of the present invention is to provide a novel cover and container assembly that provides a built-in mechanism to open the container.

SUMMARY OF THE INVENTION

These and other objects of the present invention are achieved by a novel cover and container assembly having a container portion and a cover portion wherein there is formed a bellows-like portion of at least two annular grooves separated by a ridge on the cover or container portion for dampening external pressure forces after impact and further having an interlocking assembly providing a contact area between the cover and the container. The interlocking assembly provides a snap-type closing which ensues a tighter fit with less chance of opening with one annular groove including rib members located near the edge of the cover, with the rib members providing means for separating the cover from the container.

BRIEF DESCRIPTION OF THE DRAWINGS

A better understanding of the present invention as well as other objects and advantages thereof, will become apparent upon consideration of the detailed disclosure thereof, especially when taken with the accompanying drawings, wherein.

DETAILED DESCRIPTION OF THE INVENTION

Figure 1:
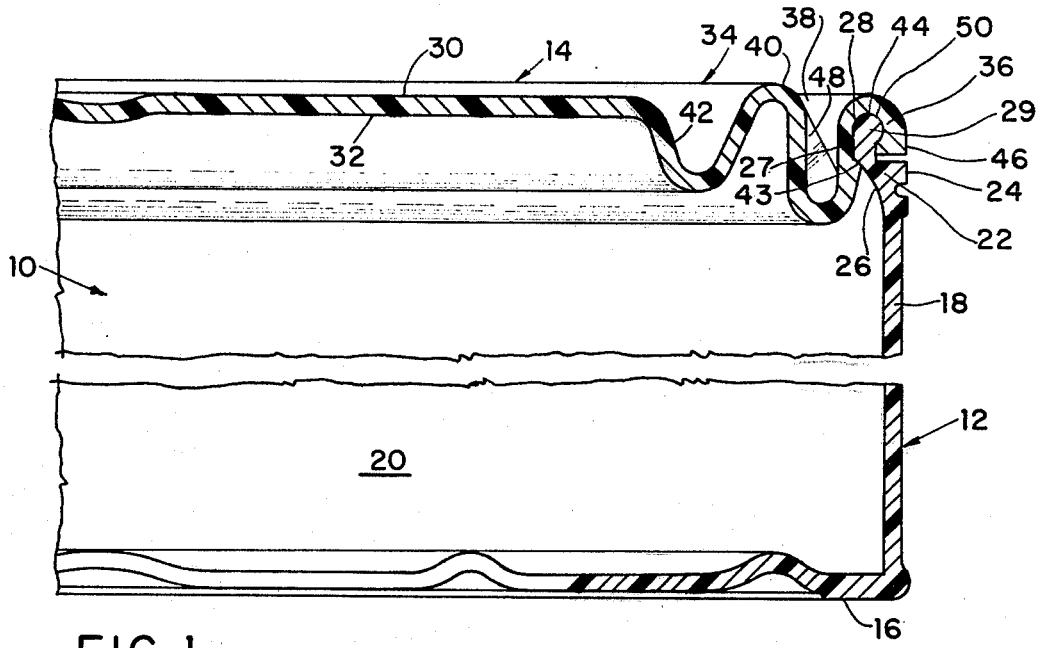
FIG. 1 is a sectional elevational view of the present invention.

Referring now to FIG. 1, there is shown a plastic cover and container assembly, generally indicated as 10, comprised of a container portion 12 and a cover portion 14. The container portion 12 is formed of a bottom wall 16 and a cylindrically shaped side wall 18 forming a chamber 20 for holding miscellaneous material. The side wall 18 extends upwardly terminating in an interlocking assembly, generally indicated as 22.

The assembly 22 is formed of an annular lip portion 24 perpendicular to side wall 18, leading to a neck portion 26 offset from said side wall 18. The neck portion 26 is continuous with an interior horizontal wall 27 parallelly disposed to said side wall 18 and a semi-circular portion 28 returning to and terminating at said neck portion 26 and forming an annular locking member 29.

The cover portion 14 is circular in shape having an outer wall 30 and an inner wall 32. The combination of outer wall 30 and inner wall 32 further comprises a peripherally-formed annular bellows-like portion of at least two grooves and two ridges, defining a radius, generally indicated as 34. The peripherally-formed annular bellows-like portion 34 is comprised of an outer peripheral ridge portion 36 continuous with an outer annular groove 38. Continuous with the outer annular groove 38 is an inner ridge portion 40 and an inner annular groove 42. Ridge portion 36 cooperatively forming with outer annular groove 38 interlocking assembly 44 which is positioned to cooperatively engage the interlocking assembly 22 on side wall 18 of container portion 12. Said outer peripheral ridge portion 36 having been formed by said outer wall 30 and said inner wall 32 of said cover 14 and downwardly directed edge wall member 46. Inserted within the outer annular groove area is a plurality of rib members, generally indicated as 48, to assist in removing the cover portion 14 from side wall 18.

Outer annular groove 38 is formed with an outwardly directed abutting portion 49. The said outwardly directed abutting portion 49 located on the inner wall 32 of cover 14 which in conjunction with the downwardly directed wall member 46 form an annular locking slot 50 of a conforming shape wherein the annular locking member 29 of sidewall 18 can be cooperatively inserted to form a tight fit and form a seal. This thereby joins the interlocking assembly 22 of side wall 18 with the interlocking assembly 44 of cover 14.

Figure 2:
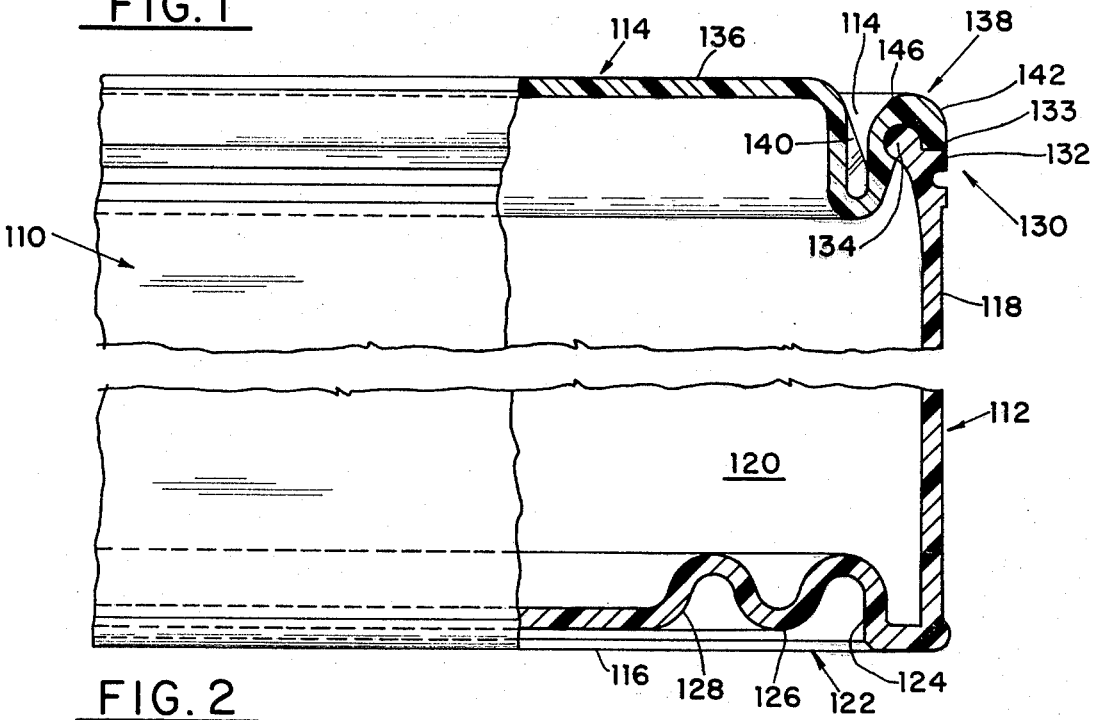
FIG. 2 is a sectional elevational view of another embodiment of the present invention.

Referring now to FIG. 2, there is shown a plastic cover and container assembly, generally indicated as 110, comprised of a container portion 112 and a cover portion 114.

The container portion 112 is formed of a bottom wall 116 and a cylindrically shaped side wall 118 forming a chamber 120. The bottom wall 116 is formed with a peripherally-formed annular bellows-like portion of at least two grooves separated by a ridge, generally indicated as 122. The peripherally-formed annular bellows-like portion 122 is comprised of an outer annular groove 124, a ridge 126 and an inner annular groove 128.

Side wall 118 extends upwardly terminating in an interlocking assembly, generally indicated as 130. Interlocking assembly 130 is formed of an annular lip portion 132 perpendicular to side wall 118, and extending therefrom a neck portion 133 offset from said side wall 118. The neck portion 133 terminates in an annular bead member 134.

The cover portion 114 is formed of a top wall 136 terminating in a peripherally-disposed interlocking assembly, generally indicated as 138, which is cooperatively engageable with the interlocking assembly 130 on side wall 118 to form a seal. The peripherally-disposed interlocking assembly 138 is formed of an outer peripheral ridge portion 142 continuous with an interior annular groove 144. The combination of the outer peripheral ridge portion 142 and the interior annular groove 144 form an annular locking slot 146 of a conforming shape to the annular bead member 134 of sidewall 118 so the bead member 134 can be cooperatively inserted to form a tight fit. Inserted within the interior annular groove area is a plurality of rib members, generally indicated as 140, to assist in removing the cover portion 114 from side wall 118.

Figure 3:
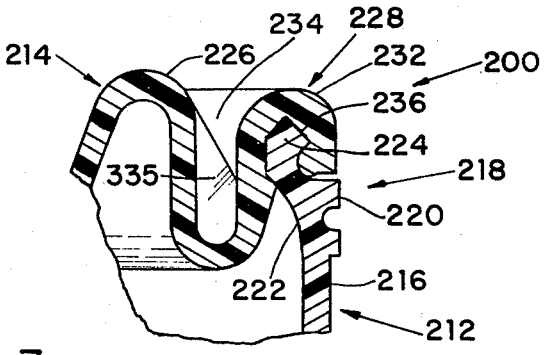
FIG. 3 is a partial sectional view of another embodiment of an interlocking assembly to be used with the present invention.

Referring now to FIG. 3, there is shown another embodiment of a sealing assembly, generally indicated as 200, which can replace the interlocking assemblies shown in FIGS. 1 or 2.

Sealing assembly 200 is comprised of a container portion 212 and a cover portion 214. The container portion 212 is formed of a bottom wall (not shown) and a cylindrically shaped side wall 216. The side wall 216 extends upwardly terminating in an interlocking assembly generally indicated as 218. Interlocking assembly 218 is formed of an annular lip portion 220 perpendicular to side wall 216, and extending therefrom a neck portion 222 offset from said side wall 216. The neck portion 222 terminates in an annular angular member 224.

The cover portion 214 is formed of a top wall 226 terminating in a peripherally-disposed interlocking assembly generally indicated as 228, which is cooperatively engageable with the interlocking assembly 218 on side wall 216 to form a seal. The peripherally-disposed interlocking assembly 228 is formed of an outer peripheral ridge portion 232 continuous with an interior annular groove 234. Additionally, interior annular groove 234 contains a plurality of rib members 235 to assist in separating the cover portion 214 from the container portion 212.

Sealing assembly 200 can be substituted for the sealing assemblies shown and described in FIGS. 1 and 2 in combination with the bellows-like device described therein.

The combination of the outer peripheral ridge portion 232 and the interior annular groove 234 form an annular locking slot 236 of a conforming shape to the annular angular member 224 on the side wall 216 of container 212. Annular angular member 224 can be cooperatively inserted into locking slot 236 to form a seal.

The bellows-like portion located on either the cover portion or the container portion, whether peripherally or internally disposed, acts so as to shield a slow rate of increase of an internal pressure and lowers the maximum pressure level it would otherwise reach after an impact. The specific radius of the bellows-like portion is a function of the desired degree of deflection wherein the lengthening or the reducing of the radius will vary according to the materials of manufacture and dimensions. Additionally, the bellows-like portion allows the container to rebound back to the original shape of the container. Further, the bellows-like portion dampens any internal pressure from acting upon the seal.

Numerous modifications and variations of the above disclosed invention are possible in light of the above teachings and, therefore, within the scope of the appended claims the invention may be practiced otherwise than any particularly described.

What is claimed:

1. A cover and container assembly comprising:

(a) a container portion having a bottom wall, a side wall extending therefrom, and an interlocking assembly projecting upwardly from a terminus thereof, said interlocking assembly being formed of a neck portion and a locking member; and (b) a cover portion having a top wall terminating in a peripherally disposed interlocking assembly and an annular bellows-like portion of at least two grooves separated by a ridge, said interlocking assembly being formed with a locking slot of a conforming shape to said locking member of said container portion cooperatively engageable with said locking member to form a seal.

2. A cover and container assembly comprising:

(a) a container portion having a bottom wall, a side wall extending therefrom, and an interlocking assembly projecting upwardly from a terminus thereof, said bottom wall having an annular bellows-like portion of at least two grooves separated by a ridge and said interlocking assembly being formed of a neck portion and a locking member; and (b) a cover portion having a top wall terminating in a peripherally disposed interlocking assembly, said interlocking assembly being formed with a locking slot of a conforming shape to said locking member of said container portion cooperatively engageable with said locking member to form a seal.

3. The cover and container assembly as defined in claims 1 or 2 wherein said annular bellows-like portion is comprised of an outer annular groove, a ridge continuous with said outer annular groove and an inner annular groove connected to said outer annular groove by said ridge.

4. The cover and container assembly as defined in claims 1 or 2 wherein said annular bellows-like portion is peripherally disposed.

5. The cover and container assembly as defined in claim 1 wherein said outer annular groove abuts to and is continuous with said interlocking assembly on said cover portion.

6. The cover and container assembly as defined in claim 2 wherein said outer annular groove abuts to and is continuous with said sidewall.

7. The cover and container assembly as defined in claim 1 wherein said cover portion is formed of an outer wall and an inner wall forming a peripherally disposed bellows-like portion having an outer peripheral ridge portion, an outer annular groove continuous therewith, an inner ridge portion and an inner annular groove, said outer peripheral ridge being formed by said outer and inner walls of said cover portion and a downwardly directed wall edge member and said outer annular groove having an outwardly directed abutting portion on said inner wall of said cover, said outwardly directed abutting portion and said downwardly directed edge wall member forming said locking slot of conforming shape to said locking member on said container portion.

8. The cover and container assembly as defined in claim 2 wherein said cover portion is formed of an outer wall and an inner wall having an outer peripheral ridge portion and an outer annular groove continuous therewith, said outer peripheral ridge being formed by said outer and inner walls of said cover portion and a downwardly directed wall edge member and said outer annular groove having an outwardly directed abutting portion and said downwardly directed edge wall member forming said locking slot of conforming shape to said locking member on said container portion.

9. The cover and container assembly as defined in claim 7 or 8 wherein said interlocking assembly projecting upwardly from said terminus of said sidewall is formed of an annular lip portion perpendicular to said sidewall, an annular neck portion inwardly offset from said sidewall and continuous with said lip portion and an annular locking member continuous with said neck portion cooperatively engageable with said locking slot on said cover portion.

10. The cover and container assembly as defined in claims 7, 8 or 9 further comprising at least one rib member in said outer annular groove.

11. The cover and container assembly as defined in claim 9 wherein said locking member is formed of a horizontal wall parallelly disposed to said side wall and continuous with said neck portion and a semi-circular bead portion continuous with said horizontal wall terminating at said neck portion.

12. The cover and container assembly as defined in claim 9 wherein said locking member is an annular globular bead member.

13. The cover and container assembly as defined in claim 9 wherein said locking member is an annular angular member.

* * * * *